US005702864A

United States Patent [19]

Pilot et al.

[11] Patent Number: 5,702,864

[45] Date of Patent: Dec. 30, 1997

[54] REDUCED SCRATCH SENSITIZATION IN NUCLEATED PHOTOGRAPHIC FILM

[75] Inventors: John F. Pilot, Carteret; Shirley M. Madamba, Middletown; Penny M. Mullen, Howell, all of N.J.

[73] Assignee: Sun Chemical Corporation, Fort Lee, N.J.

[21] Appl. No.: 706,015

[22] Filed: Aug. 30, 1996

[51] Int. Cl.[6] ..... G03C 1/76; G03C 1/04

[52] U.S. Cl. ..... 430/264; 430/523; 430/961

[58] Field of Search ..... 430/264, 523, 430/961

[56] References Cited

U.S. PATENT DOCUMENTS

| | | | |
|---|---|---|---|
| 3,730,727 | 5/1973 | Olivares et al. | 96/95 |
| 4,224,401 | 9/1980 | Takada et al. | 430/437 |
| 4,269,929 | 5/1981 | Nothnagle | 430/264 |
| 4,686,167 | 8/1987 | Resnick et al. | 430/264 |
| 4,777,113 | 10/1988 | Inoue et al. | 430/264 |
| 4,798,780 | 1/1989 | Hall et al. | 430/264 |
| 4,882,261 | 11/1989 | Kojima et al. | 430/264 |
| 4,937,160 | 6/1990 | Rüger | 430/264 |
| 5,224,772 | 7/1993 | Piechowski et al. | 430/264 |
| 5,451,486 | 9/1995 | Pilot et al. | 430/264 |
| 5,541,049 | 7/1996 | Ballerini et al. | 430/527 |
| 5,571,665 | 11/1996 | Ballerini et al. | 430/527 |

*Primary Examiner*—Mark F. Huff
*Attorney, Agent, or Firm*—Sidney Persley

[57] ABSTRACT

A hybrid lith photographic film substantially resistant to the formation of scratch-related defects that occur during the manufacturing and handling process having an anti-abrasion coating on the silver halide emulsion layer containing a polyalkylene oxide surfactant.

20 Claims, No Drawings

REDUCED SCRATCH SENSITIZATION IN NUCLEATED PHOTOGRAPHIC FILM

FIELD OF THE INVENTION

The present invention relates to novel hybrid lith photographic film substantially resistant to the formation of scratch-related defects typically incurred during the manufacturing process and film handling procedure. The invention also encompasses the novel process by which these films are produced. The invention also relates to an anti-abrasion coating composition that can be applied to emulsion coated hybrid lith films to reduce or entirely eliminate their propensity to form scratch sensitized marks.

BACKGROUND OF THE INVENTION

The utilization of silver halide technology in the Graphic Arts Industry has focused primarily on the creation of high contrast systems, which are necessary to obtain strong image discrimination and good image quality/dot characteristics. The earliest high contrast system, called the "lith" system, utilized a low sulfite, hydroquinone based, developer and a silver chlorobromide emulsion, further modified by polyethyleneoxide. However, the lith system developer and developing method were complicated, unstable and time-consuming, so improvements were vigorously pursued.

Auxiliary developers and "rapid access" developers were introduced to the Graphic Arts industry as improvements, primarily through the addition of sulfites. These developers overcame the outstanding problems of lith system developers and provided compatibility with non-lith type films. However, image discrimination and dot characteristics suffered. To regain the excellent dot quality of lith films, formyl phenylhydrazine nucleators were developed and incorporated, first into developers and then into film. The nucleators achieved the dot quality of lith-type films and allowed the reformulation of developers to reduce or entirely eliminate the use of troublesome sulfite system stabilizers.

U.S. Pat. No. 3,730,727 discusses the use of formyl phenylhydrazines incorporated in developer to improve image discrimination without the use of low-sulfite lith techniques. This concept was shortly brought to practice in the lith system described in U.S. Pat. No. 4,224,401, which teaches a lith-type result with a high pH, high sulfite-type developer solution. In U.S. Pat. No. 4,269,929, the system is further refined by employing alkanol amines as "boosters". These boosters lower the operable pH of the developer rendering it more stable, thus permitting the commercialization of a class of developers known as "hybrid" developers. Hybrid developers provide the results of lith developers but do so at rapid access developing speeds.

Subsequent to the foregoing disclosures, U.S. Pat. Nos. 4,686,167, 4,798,780, 4,937,160, and 4,882,261, disclose novel hydrazine "nucleators" which afford the hybrid effect. In U.S. Pat. No. 5,451,486, incorporated herein by reference, novel hydrazide nucleating agents are disclosed which produce better dot quality and superior contrast on image-wise exposed film. These novel nucleating agents are compatible with rapid access developers and obviate the need to incorporate boosters.

Remarkable advances in high contrast film development have made excellent hard dot quality films commonplace in the market place. Yet, the very chemistry of derivatized hydrazine nucleators that has afforded these sought for improvements, aggravate some long standing problems or present new problems to the manufacture of quality film. One such problem is the formation of marks or defects that can appear, as a result of the manufacturing and handling process, in the non-image bearing portion of a nucleated film prior to exposure and development.

It is known that negative-type, high contrast, silver halide photographic emulsions, containing hydrazides, induce a susceptibility to scratch sensitization in the coated film. Scratch sensitization refers to the enhanced propensity or sensitivity of hybrid lith film to incur mechanically induced imperfections. During the film manufacturing process, wherein the polyester substrate is coated with a silver halide emulsion and subsequently dried, machine operations and film handling often result in small abrasions to the emulsion surface. When the finished film is image-wise exposed and developed these abrasions, sensitized by the hydrazide formulation, are exhibited as developed silver marks in portions of the film that have not experienced image-wise exposure. The result is an exposed film product of inferior quality.

The appearance of these developed silver marks can be reduced by adding hydroquinone to the emulsion. However, hydroquinone is not chemically stable and can age by oxidization during the coating process or thereafter causing the emulsion to lose speed.

U.S. Pat. No. 5,244,772 teaches adding ascorbate and/or sodium formaldehyde bisulfite to the process holding tank for the emulsion, to retard hydroquinone oxidation and achieve a more stable emulsion, more resistant to scratch sensitization.

U.S. Pat. No. 4,777,113 describes a silver halide photographic material containing a silica-containing double overlay and specific compounds comprising hydrazine derivatives. The material exhibits high contrast and is less susceptible to scratch.

While these and other means, have been described in the art to overcome the propensity toward scratch sensitization inherent in hybrid lith films, the need for a fully satisfactory means, i.e., one which is cost-effective and convenient without impairing photographic quality, remains. Accordingly, it is an objective of the present invention to provide a nucleated or hybrid lith photographic film that is substantially desensitized to the formation of developable silver marks.

Another objective of the invention is to provide a method of preparing the foregoing scratch desensitized film.

Yet a further objective of the invention is to provide an anti-abrasion coating composition that can be entirely applied to emulsion coated hybrid lith films to reduce or eliminate their propensity to form scratch sensitized marks, but without degrading their hard dot performance qualities.

SUMMARY OF THE INVENTION

Most unexpectedly, it has been discovered that certain surfactants, when incorporated in small quantities, with a hardening agent into the anti-abrasion coating layer of a hybrid lith film substantially reduce or entirely eliminate the scratch sensitivity of the film without compromising its hard dot performance. The anti-abrasion coating, as modified to contain the effective surfactants and a hardener, can be coated directly onto the emulsion layer of a polyester film in a process compatible with established film manufacturing methods.

The surfactants useful in the present invention are drawn from a select group of anionic and non-ionic surfactants. However, the most effective and preferred surfactants contain recurring units of ethylene oxide as hydrophile or propylene oxide as hydrophobe. These ethylene and propylene oxide segments can also contain a polysiloxane or fluorocarbon as hydrophobe, incorporated as an adduct or in a block copolymer configuration.

Hardeners which can be used in the anti-abrasion layer in conjunction with the select polyalkylene oxide surfactant can be selected from hardeners well known in the art as described hereinafter.

More particularly, the invention comprises a scratch resistant, negative-type, nucleated silver halide photographic material having a substrate, a first light-sensitive silver halide emulsion layer coated on the substrate containing at least one nucleator having a derivative of hydrazine; and an aqueous, gelatin-based anti-abrasion layer coated on said first layer. The anti-abrasion layer contains a scratch-desensitizing amount of an oligomer having at least one polyalkylene oxide containing 4 to 40 recurring units of ethoxylate and a hardener.

A preferred photographic material comprises an anionic surfactant having either structure below:

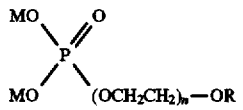

I

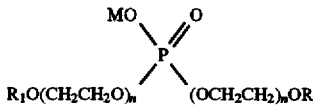

II wherein M is hydrogen or a metal cation, R and $R_1$ are individually selected from linear or branched $C_1$–$C_{18}$ alkyl or alkylaryl groups, and n is an integer between 4 and 40.

Another preferred photographic material comprises an oligomer or a non-ionic surfactant containing a symmetrical block copolymer having the configuration of A-B-A wherein A comprises recurring units of ethoxylate when B comprises recurring unit of propoxylate or wherein A comprises recurring unit of propoxylate when B comprises recurring units of ethoxylate. The block copolymer has a molecular weight between 1000 and 20,000.

Another preferred photographic material is an oligomer or a non-ionic surfactant alkoxylate of ethylene diamine having the configuration $(A\text{-}B)_2\text{-}Z\text{-}(B\text{-}A)_2$ wherein A comprises recurring units of ethoxylate when B comprises recurring unit of propoxylate or wherein A comprises recurring unit of propoxylate when B comprises recurring units of ethoxylate and Z, in either case, is tetra substituted ethylene diamino. The alkoxylate of the ethylene diamine has a molecular eight between 2,000 and 25,000.

Another preferred photographic material is an oligomer selected from fluroroalkyl alcohol substituted polyethylene glycols and polysiloxane polyalkylene ether copolymers having recurring block copolymeric units of ethoxylate and propoxylate.

The scratch resistant, negative-type, nucleated silver halide photographic material is prepared by coating a substrate with a first layer comprising a silver halide photographic emulsion containing at least one nucleator comprising a derivative of hydrazine. The first layer is then coated with a gelatin-based anti-abrasion coating layer comprising a scratch-desensitizing amount of an oligomer comprising at least one polyalkylene oxide containing 4 to 40 recurring units of ethoxylate and a hardener. Next the coated substrate is dried to produce the scratch resistant photographic material.

DETAILED DESCRIPTION OF THE INVENTION

The invention pertains to a negative-type high contrast photographic emulsion containing hydrazides wherein the emulsion has a reduced sensitization to scratch formation, i.e., an emulsion that is resistant to the formation of developed silver markings or black lines in the non-image area of the film subsequent to image-wise exposure and development. The improvement in scratch desensitization is achieved by incorporating select polyalkylene oxide-based surfactants in an anti-abrasion hardener that is coated on top of the hydrazide emulsion layer.

The mechanism by which these specific polyalkylene oxides function to reduce scratch sensitization in hybrid lith films is not fully understood. However, it has been determined that those surfactants contained in an anti-abrasion layer containing a hardener are scratch-desensitizing when they contain an amount of oligomer having at least one polyalkylene oxide comprising 4 to 40 recurring units of ethoxylate.

The group of surfactants found to be effective in the present invention include: mono or di phosphate esters of ethoxylated alkoxide or alkylaryloxide, symmetrical block copolymers, having the configuration of (i) A-B-A wherein A comprises recurring units of ethoxylate when B comprises recurring unit of propoxylate or wherein A comprises recurring unit of propoxylate when B comprises recurring units of ethoxylate; alkoxylates of ethylene diamine having the configuration (ii) $(A\text{-}B)_2\text{-}Z\text{-}(B\text{-}A)_2$ wherein A comprises recurring units of ethoxylate when B comprises recurring unit of propoxylate or wherein A comprises recurring unit of propoxylate when B comprises recurring units of ethoxylate and Z, in either case, is tetra substituted ethylene diamino; and fluroroalkyl alcohol substituted polyethylene glycols and polysiloxane polyalkylene ether copolymer having recurring block copolymeric units of ethoxylate and propoxylate.

The term ethoxylate as employed herein refers to an ethylene oxide oligomer having recurring units with the structure $—(CH_2CH_{20})_n—$ wherein n an integer of 2 to 40. The ethylene oxide oligomer may form the hydrophile portion of an ionic or non-ionic surfactant containing a complementary hydrophobic or hydrophilic portion. For example, the surfactant may be a phosphorylated anionic surfactant, a block copolymer with polypropylene oxide, or include a hydrophobic portion such as silanes or fluorinated alkyl radicals.

The high contrast film of the invention is prepared preferably by using polyester as a substrate; but any substrate known in the art can also be utilized including polyolefins, cellulose acetate and polyvinyl acetate. By techniques well known in the art, the substrate is coated with a silver halide photographic emulsion that contains a derivatized hydrazine-based nucleator. Many such nucleators are known in the art and the instant discovery is not limited to the choice of hydrazine nucleators.

Once coated on the substrate, the silver halide photographic emulsion is coated with gelatin-based aqueous anti-abrasion layer that contains a hardener or hardening agent, preferably dimethylol urea or 1-(N,N-dimethylcarbamoyl)-(2-sulfoethylpyridinum) hyroxide-inner salt. However, other hardeners, described in *The Theory of the Photographic Process* by T. H. James, Fourth Edition, Macmillan Publishing Co., pp. 77–87, incorporated herein by reference, may be useful in the anti-abrasion coating of the invention. These hardeners include inorganics such as chrome alum; aldehydes such as formaldehyde, glyoxal and glutaraldehyde; N-methylol compounds such as the aforenoted dimethylol urea and methylol-dimethylhydantoin; active vinyl compounds such as 1,3,5-triacryloyl-hexahydro-s-triazine; active halogen compounds such as 2,4-dichloro-6-hydroxy-s-triazine; mucohalogenic acids such as mucochloric acid; and epoxides such as tris-(2,3-epoxy-propyl)-isocyanurate.

The anti-abrasion layer also includes one or more select polyalkylene oxide surfactants discovered to be so effective in scratch desensitization of the emulsion and disclosed in Table 1. A preferred polyalkylene oxide (PAO) is Rhodafac RS-610, available from Rhone-Poulenc. After coating with the anti-abrasion layer, the test film is dried then oven aged for 24 hours at 120° F. and 20% relative humidity.

The (PAO) surfactant useful in the invention is utilized at levels between 1 and 15 grams per u, where "u" is a unit of overcoat equal to 100 grams of solid gel diluted to 4 kg of total weight. A unit of overcoat (u) coats approximately 2000 square feet of film at a dried thickness of 0.8 microns. A preferred level of use for an effective PAO surfactant is between 2 and 8 g/u, most preferably between 4 and 6 g/u for Rhodafac RS-610 surfactant.

A detailed description of the preparation of photographic films containing a variety of different surfactants and tested for scratch desensitization in a hard dot camera film is presented in Example 1. The PAO surfactants which are effective as scratch desensitizers in Hard Dot camera film are also effective in Hard Dot camera films which have been spectrally sensitized for Argon or HeNe laser exposures.

EXAMPLE 1

An 80:20 percent chloro-bromide emulsion having cubic crystals of 0.25 micron edge length was prepared by an ammoniacal method using a balanced double jet precipitation of one mole of 1.2 normal silver nitrate, and a 1.55 mole mixture of potassium bromide/ammonium chloride with 2.2 grams per mole of ethylenediamine and 335 nanomoles per mole of sodium hexachlorohodate into a 3.6 weight percent gel solution at a pH of 8 over a 15 minute period at 35° C. The soluble byproduct salts were removed by washing with water after coagulating with an aromatic sulfonate at low pH. The emulsion was then redispersed to a 6 percent silver analysis with 50 grams of gelatin, and was digested at 50° C. for 42 minutes at a pH of 6 in the presence of 0.05 mole potassium iodide, 7 mg sodium benzenethionosulfinate, 11 micromoles sodium tetrachloroaurate, and 31 micromoles of sodium thiosulfate. The emulsion was stabilized with 4500 micromoles of 4-hydroxy-6-methyl-1,3,3a,7-tetraazaindene, spectrally sensitized with 5-(3-ethyl-2-triazolidine) ethylidene)-4-oxo-2-thioxo-3-thiazolidine acetic acid. Sodium dioctyl sulfosuccinate was added as a coating aid at 0.7 grams per mole of silver, a latex for dimensional stability was added, and a hydrazine nucleator (structure III in Table 5) was added as a methanol solution at the level of $8.5\times10^4$ mole per mole of silver. The emulsions were then coated onto a polyester base at a coating weight of 40 mg of silver per square decimeter, and were overcoated with an aqueous anti-abrasion layer containing a silica matting agent at 1.5 or 12 grams per unit of overcoat, i.e., u, and dimethylolurea as a hardening agent. The PAO test compounds were added into this aqueous liquid anti-abrasion formulation as aqueous solutions as the last additive before coating. The dried film samples were then oven aged for 24 hours at 120° F. and 20% relative humidity to simulate results expected with natural aging.

For the foregoing Example 1, one unit (u) of aqueous anti-abrasion layer was prepared by first dispersing Silcron G-100 (SCM Chemical Inc.) as the matting agent in deionized water at 60°–80° F. Gelatin is then added and cold soaked for 30 minutes with stirring. The solution is then brought to 130° F. for 30 minutes with stirring to allow the gelatin to dissolve. After 30 minutes at 130° F., the solution is cooled to 100° F. and non-PAO surfactants sodium dioctyl sulfosuccinate and FC-100 (3M Corp) plus a hardening agent (dimethylolurea) were added. An adjustment to pH 5.5 using sulfuric acid was made and the final solution was divided. The polyalkylene oxides were added to the divided portions as aqueous solutions in the amounts listed in Table 1. The resulting solution was then applied to the emulsion layer at 8 mg of gel/$dm^2$.

The useful ranges for the components of the anti-abrasion layer are: 5–15 mg/$dm^2$ for gel thickness, 1–15 grams/unit for matte, 0.5gms/unit or as needed for the non-polyalkylene oxide surfactants and 5–20 gms/unit for the hardening agent (dimethylol urea).

The films were evaluated for scratch sensitizing by simply hand stroking several times across the surface of the unexposed film, followed by processing the unexposed samples in a developer whose composition is listed in Table 3, and fixing with a fixer described in Table 4. The samples were then subjectively graded for A=no sensitized scratches to E=very strongly sensitized scratches, i.e., black sensitized scratches versus the control film. The surfactants tested and the results are tabulated in Table 1. Tests were carried out at two levels of matte concentration since polyalkylene oxide (PAO) can be absorbed by the matte which reduces the effectiveness of the PAO as an agent for the reduction of scratch sensitization.

The control films used for each series of experiments were the test films prepared according to Example 1, but absent the surfactant being evaluated in the anti-abrasion layer. The controls always produced a scratch grade of E, i.e., very strongly sensitized scratches.

Surfactant suppliers by trade name are: Rhodafac, Tetronic and Igepal—Rhone-Poulenc; Pluronic—BASF; Silicone 190—Dow Corning; Zonyl and Merpol OJ,—DuPont; and Hostapur—American Hoechst Corp.

In general, sensitometry (i.e, speed, contrast, fog, etc.) were obtained in the normal manner, and were indistinguishable from the control over the range of levels used. Therefore, the important hard dot quality of the films of the invention were retained while the reduction in scratch sensitization was accomplished.

EXAMPLE 2

A series of films was prepared as in Example 1 using certain of the surfactants listed in Table 1. In this series of experiments the emulsions were formulated using different nucleators shown as structures IV, V and VI of Table 5 and further described in U.S. Pat. Nos. 5,439,776 and 5,451,486. The purpose of the series of experiments was to determine whether the beneficial result obtained with respect to scratch desensitization was restricted to the nucleator used in the emulsions prepared in Example 1 or can be achieved with other nucleators known in the art. The results, tabulated in Table 2, show that scratch desensitization is a function of the surfactant selected and is independent of the selected nucleator.

TABLE 1

POLYALKYLENE OXIDES TESTED FOR SCRATCH SENSITIZATION

| Surfactant Class | Surfactant Tested | MW | Matte (g/u) | Scratch Results Amount of Polyalkylene Oxide (PAO) 1 g/u | 2 g/u | 4 g/u | 6 g/u | 8 g/u | 10 g/u |
|---|---|---|---|---|---|---|---|---|---|
| Control 1 | None | — | 1.5 | No PAO added, results = E | | | | | |
| Control 2 | None | — | 12 | No PAO added, results = E | | | | | |
| PHOSPHATES: | | | | | | | | | |
| Alkyl-$(EO)_n$-Phosphate | Rhodafac RS-410 (n = 4) | | 1.5 | E | E | E | C | | |
| Alkyl-$(EO)_n$-Phosphate | Rhodafac RS-610 (n = 6) | | 1.5 | C | B | A | A | | |
| Alkyl-$(EO)_n$-Phosphate | Rhodafac RS-710 (n = 7) | | 1.5 | C | B | B | A | | |
| Nonyl-Phenol-(EO)n-Phosphate | Rhodafac RE-410 (n = 4) | | 1.5 | E | E | E | C | | |
| SYMMETRICAL NON-IONICS: | | | | | | | | | |
| EO-PO-EO (Low EO, Low PO) | Pluronic L-62 | 2500 | 1.5 | B | B | B | B | | |
| EO-PO-EO (Med. EO, Low PO) | Pluronic P-65 | 3400 | 1.5 | B | A | A | A | | |
| EO-PO-EO (High EO, Low PO) | Pluronic F-68 | 8400 | 1.5 | E | E | C | C | | |
| EO-PO-EO (Low EO, High PO) | Pluronic P103 | 4950 | 1.5 | D | B | B | A | | |
| EO-PO-EO (Med EO, High PO) | Pluronic P105 | 6500 | 1.5 | E | D | A | A | | |
| EO-PO-EO (High EO, High PO) | Pluronic F108 | 14600 | 1.5 | B | B | A | A | | |
| EO-PO-EO (Med. EO, Low PO) | Pluronic 17R4 | 2650 | 1.5 | E | E | E | D | | |
| EO-PO-EO (High EO, High PO) | Pluronic 25R8 | 8550 | 1.5 | E | E | C | A | | |
| $(PO\text{-}EO)_2NCH_2CH_2N(EOPO)_2$ | Tetronic 90R4 | 7240 | 1.5 | E | B | A | E | | |
| $(EO\text{-}PO)_2NCH_2CH_2N(POEO)_2$ | Tetronic 701 | 3600 | 1.5 | E | E | E | C | | |
| $(EO\text{-}PO)_2NCH_2CH_2N(PO\text{-}EO)_2$ | Tetronic T-704 | 5500 | 1.5 | E | D | C | C | | |
| $(EO\text{-}PO)_2NCH_2CH_2N(PO\text{-}EO)_2$ | Tetronic T-1307 | 18000 | 1.5 | A | A | A | B | | |
| UNSYMMETRICAL NON-IONICS: | | | | | | | | | |
| Nonyl-Phenol-$(EO)_n$-H | Igepal CO-610 (n = 7.5) | | 1.5 | E | D | D | C | | |
| Nonyl-Phenol-$(EO)_n$-H | Igepal CO-660 (n = 10) | | 1.5 | E | D | C | B | | |
| Nonyl-Phenol-$(EO)_n$-OH* | Igepal CO-977 (n = 50) | | 1.5 | E | E | E | E | | |
| Nonyl-Phenol-$(EO)_n$-H* | Igepal CO-987 (n = 70) | | 1.5 | E | E | E | E | | |
| Silicone-$EO_m$-H | ABIL B-8842 | | 1.5 | | | A | | | |
| Fluoro-Alkyl-$(EO)_n$-H | Zonyl FS-300 | | 1.5 | | | A | | | |
| Alcohol Ethoxylate | Merpol OJ | | 1.5 | | | A | | | |
| Alkyl polyglycol ether | Hostapur CX Hi-Conc. | | 1.5 | D | B | A | A | | |
| Alkyl-$(EO)_n$-Phosphate | Rhodafac RS-610 (n = 6) | | 12 | | | E | C | A | A |
| $(EO\text{-}PO)_2NCH_2CH_2N(PO\text{-}EO)_2$ | Tetronic T-1307 | | 12 | | | A | A | A | |
| Silicone-Pr-$EO_m$-$PO_n$-H | Dow Corning 190 | | 12 | E | C | A | | | |
| Silicone-$EO_m$-H | ABIL 8842 | | 12 | | | B | A | A | |
| Fluoro-Alkyl-$(EO)_n$-H | Zonyl FS-300 | | 12 | | | E | E | E | |
| Alcohol Ethoxylate | Merpol OJ | | 12 | | | | | C | |

*Comparative Example

TABLE 2

SCRATCH SENSITIVITY WITH VARIOUS NUCLEATORS

| PAO Tested | Scratch Grade For Each Nucleator: Nucleator IV | Nucleator V | Nucleator VI |
|---|---|---|---|
| None (control) | E | E | E |
| RS-610 | A | A | A |
| RS-410 | A | A | A |
| RS-710 | A | A | A |
| P-65 | D | E | E |
| F-108 | A | A | A |
| T-1307 | A | A | A |
| Zonyl FS-300 | A | A | A |
| ABIL B-8842 | B | A | A |
| Merpol OJ | B | A | A |
| Dow Corning 190 | C | A | A |

Note: Each nucleator was added at $1 \times 10^{-3}$ mole per mole of silver.

TABLE 3

COMPOSITION OF DEVELOPER

| Raw Materials | AMOUNT (g/l)* |
|---|---|
| Potassium Hydroxide, 45% | 68.66 |
| Hydroquinone | 24.66 |
| Versenol-120 | 5.33 |
| Dimezone "S" | 0.67 |
| Potassium Carbonate Anh. | 20.66 |
| Potassium Metabisulfite | 45.33 |
| Diethylene Glycol | 10.66 |
| Diethanolamine, 85% | 14.00 |
| Sodium Erythorbate | 2.66 |
| 1-Phenyl-5-Mercaptotetrazole | 0.097 |
| Potassium Bromide | 5.0 |
| Benzotriazole | 0.20 |
| 2-Mercapto-Benzothiazole | 0.053 |
| pH | to 10.6 |
| Water | to make 1 liter |

*Processing conditions were 30 seconds at 38° C.

TABLE 4

FIXER COMPOSITION

| Ingredients | Amount (g/l)* |
|---|---|
| Ammonium Thiosulfate, 60% | 276.20 |
| Sodium Acetate, Anh. | 21.20 |
| Sodium Metabisulfite | 9.05 |
| Acetic Acid, Glacial | 8.38 |
| Citric Acid | 3.28 |
| Water | to 1.0 liter |
| pH | to 4.8 |

*Processing conditions were 30 seconds at 38° C.

TABLE 5

STRUCTURES FOR THE HYDRAZINE NUCLEATORS

III.

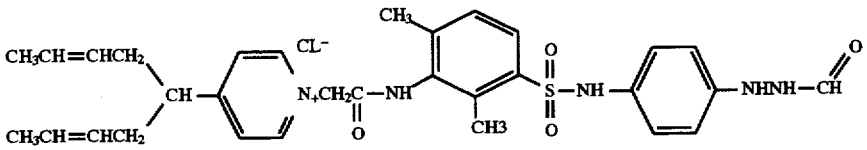

IV.

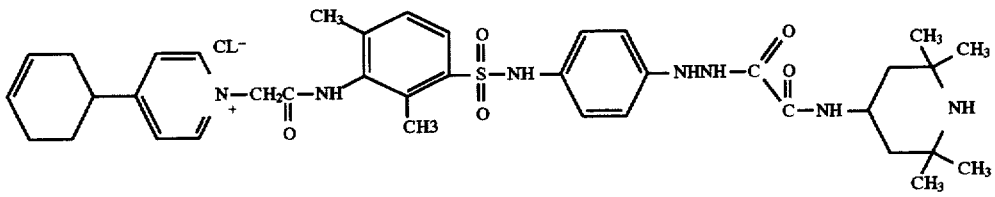

V.

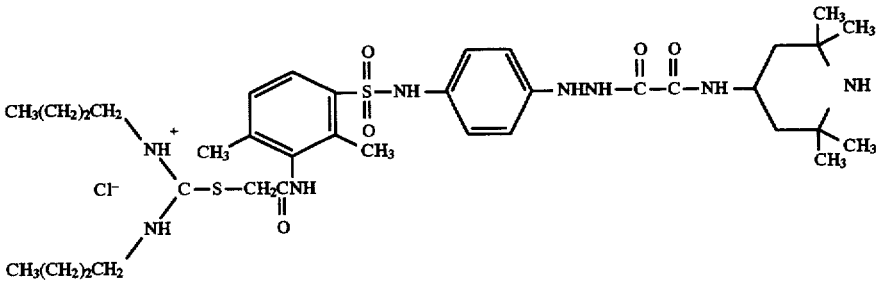

VI.

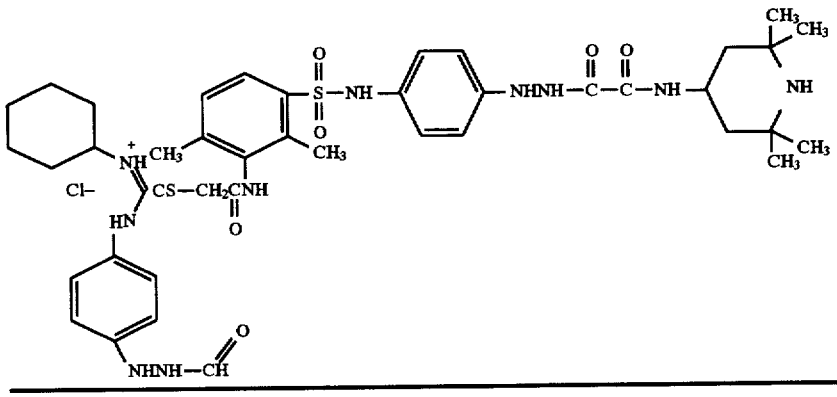

What is claimed is:

1. A scratch resistant, negative-type, nucleated silver halide photographic material comprising:

a substrate;

a first light-sensitive silver halide emulsion layer coated on said substrate, containing at least one nucleator having a derivative of hydrazine; and an aqueous, gelatin-based, anti-abrasion layer coated on said first layer, said anti-abrasion layer containing a hardening agent and an oligomer, wherein said oligomer has at least one polyalkylene oxide containing 4 to 40 recurring units of ethoxylate and is present in an amount sufficient to scratch-desensitize the photographic material.

2. The photographic material of claim 1 wherein said oligomer is an anionic surfactant comprising a mono or di phosphate ester of an ethoxylated alkoxide or alkylaryloxide.

3. The material of claim 2 wherein said anionic surfactant has either structure below:

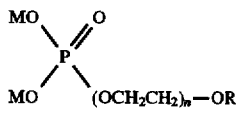

I

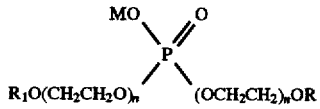

II wherein M is hydrogen or a metal cation, R and $R_1$ are individually selected from linear or branched $C_1$–$C_{18}$ alkyl or alkylaryl groups, and n is an integer between 4 and 40.

4. The material of claim 3 wherein said surfactant contains a branched alkyl group and n is between 4 and 7.

5. The material of claim 1 wherein said oligomer is a non-ionic surfactant comprising a symmetrical block copolymer having a molecular weight between 1,000 and 20,000 and the configuration A-B-A wherein A comprises recurring units of ethoxylate when B comprises recurring unit of propoxylate or wherein A comprises recurring units of propoxylate when B comprises recurring units of ethoxylate.

6. The material of claim 1 wherein said oligomer is a non-ionic surfactant alkoxylate of ethylene diamine having a molecular weight between 2,000 and 25,000 and the configuration $(A\text{-}B)_2\text{-}Z\text{-}(B\text{-}A)_2$ wherein A comprises recurring units of ethoxylate when B comprises recurring unit of propoxylate or wherein A comprises recurring units of propoxylate when B comprises recurring units of ethoxylate, and Z, in either case, is tetra substituted ethylene diamino.

7. The material of claim 6 wherein A is ethoxylate and B is propoxylate, each having a molecular weight between 15,000 and 20,000.

8. The material of claim 1 wherein said oligomer comprises fluroroalkyl alcohol substituted polyethylene glycol.

9. The material of claim 1 wherein said oligomer comprises polysiloxane polyalkylene ether copolymers having recurring block copolymeric units of ethoxylate and propoxylate.

10. The material of claim 1 wherein said hardening agent is selected from the group consisting of chromium inorganic hardeners, aldehydes, N-methylol compounds, active vinyl compounds, active halogen compounds, mucohalogenic acids and epoxides.

11. The material of claim 10 wherein said hardening agent is dimethylolurea.

12. The material of claim 1 wherein said substrate comprises polyester film.

13. A method for producing a scratch resistant, negative-type, nucleated silver halide photographic material comprising:

coating a substrate with a first layer having a silver halide photographic emulsion containing at least one nucleator having a derivative of hydrazine;

coating said first layer with an aqueous, gelatin-based, anti-abrasion coating layer containing a hardening agent and an oligomer, wherein said oligomer has at least one polyalkylene oxide containing 4 to 40 recurring units of ethoxylate and is present in an amount sufficient to scratch-desensitize the photographic material; and drying said coated substrate.

14. The method of claim 13 wherein said oligomer is selected from mono or di phosphate esters of an ethoxylated alkoxide or alkylaryloxide, symmetrical block copolymers having the configuration (i) A-B-A wherein A comprises recurring units of ethoxylate when B comprises recurring units of propoxylate or wherein A comprises recurring units of propoxylate when B comprises recurring units of ethoxylate; alkoxylates of ethylene diamine having the configuration (ii) $(A\text{-}B)_2\text{-}Z\text{-}(B\text{-}A)_2$ wherein A comprises recurring units of ethoxylate when B comprises recurring units of propoxylate or wherein A comprises recurring units of propoxylate when B comprises recurring units of ethoxylate, and Z, in either case, is tetra substituted ethylene diamino; or fluroroalkyl alcohol substituted polyethylene glycols and polysiloxane polyalkylene ether copolymers having recurring block copolymeric units of ethoxylate and propoxylate.

15. The method of claim 13 wherein the amount of scratch-desensitizing oligomer is between 1 and 20 grams per unit of overcoat.

16. The method of claim 13 wherein said hardening agent is selected from the group consisting of chromium inorganic hardeners, aldehydes, N-methylol compounds, active vinyl compounds, active halogen compounds, mucohalogenic acids and epoxides.

17. The method of claim 16 wherein said hardening agent comprises dimethylol urea.

18. The method of claim 13 wherein said substrate comprises polyester film.

19. A scratch-desensitizing coating medium for treating a photographic material, said material consisting of a negative-type, nucleated silver halide photographic emulsion on a substrate, wherein said medium comprises:

an aqueous, gelatin-based solution, having at least one hardening agent and at least one oligomer selected from mono or di phosphate esters of an ethoxylated alkoxide or alkylaryloxide, symmetrical block copolymers having the configuration (i) A-B-A wherein A comprises recurring units of ethoxylate when B comprises recurring units of propoxylate or wherein A comprises recurring units of propoxylate when B comprises recurring units of ethoxylate; alkoxylates of ethylene diamine having the configuration (ii) $(A\text{-}B)_2\text{-}Z\text{-}(B\text{-}A)_2$ wherein A comprises recurring units of ethoxylate when B comprises recurring units of propoxylate or wherein A comprises recurring units of propoxylate when B comprises recurring units of ethoxylate, and Z, in either case, is tetra substituted ethylene diamino; or fluroroalkyl alcohol substituted polyethylene glycols and polysiloxane polyalkylene ether copolymers having recurring block copolymeric units of ethoxylate and propoxylate.

20. The medium of claim 19 wherein said hardening agent is selected from the group consisting of chromium inorganic hardeners, aldehydes, N-methylol compounds, active vinyl compounds, active halogen compounds, mucohalogenic acids and epoxides.

* * * * *